US010006296B2

(12) United States Patent
Ramannagari et al.

(10) Patent No.: US 10,006,296 B2
(45) Date of Patent: Jun. 26, 2018

(54) SHROUD FOR PRE-TWISTED AIRFOILS

(71) Applicant: ALSTOM Technology Ltd, Baden (CH)

(72) Inventors: Dilli Prasad Ramannagari, Bern (CH); Pierre-Alain Masserey, Wurenlos (CH); Ross Brian Fleming, Ennetbaden (CH); Christina Calcagni, Wettingen (CH)

(73) Assignee: GENERAL ELECTRIC TECHNOLOGY GMBH, Baden (CH)

( * ) Notice: Subject to any disclaimer, the term of this patent is extended or adjusted under 35 U.S.C. 154(b) by 532 days.

(21) Appl. No.: 13/900,899

(22) Filed: May 23, 2013

(65) Prior Publication Data

US 2013/0323053 A1 Dec. 5, 2013

(30) Foreign Application Priority Data

May 31, 2012 (EP) ..... 12170319

(51) Int. Cl.
*F01D 5/22* (2006.01)

(52) U.S. Cl.
CPC ..... *F01D 5/225* (2013.01)

(58) Field of Classification Search
CPC ..... F01D 5/22; F01D 5/225; F04D 29/34
USPC ..... 415/185, 186, 189, 190; 416/212 R, 416/212 A, 215
See application file for complete search history.

(56) References Cited

U.S. PATENT DOCUMENTS 1,073,623 A * 9/1913 Owen et al. ..... F01D 5/225 29/889.21
1,304,793 A * 5/1919 Moore ..... F01D 5/225 416/191
1,639,247 A * 8/1927 Zoelly ..... F01D 5/225 416/190
2,391,623 A * 12/1945 Heppner ..... F01D 5/022 416/191
4,688,992 A 8/1987 Kirkpatrick et al.
4,840,539 A * 6/1989 Bourcier ..... F01D 5/225 416/191
4,884,951 A 12/1989 Meylan et al.
5,154,581 A * 10/1992 Borufka ..... F01D 5/225 415/173.6

(Continued)

FOREIGN PATENT DOCUMENTS

DE 606351 C 11/1934
EP 0202531 A1 11/1986

(Continued)

OTHER PUBLICATIONS

Notice of Preliminary Rejection issued in connection with corresponding JP Application No. 2015-004931 dated Feb. 28, 2017.

*Primary Examiner* — Woody Lee, Jr.
*Assistant Examiner* — Maxime Adjagbe
(74) *Attorney, Agent, or Firm* — GE Global Patent Operation; Cynthia W. Flanigan

(57) ABSTRACT

A method and a blade for a turbine or, more generally a turbomachine, are described with the blade having at a top end a shroud segment designed to engage with shroud segments of adjacent blades in an ring-shaped assembly at least partly by means of assembling the blades with the shroud segment having a central indentation along an engaging face.

11 Claims, 5 Drawing Sheets

(56) References Cited

U.S. PATENT DOCUMENTS

| | | | | |
|---|---|---|---|---|
| 5,211,540 | A * | 5/1993 | Evans | F01D 5/225 416/190 |
| 5,522,705 | A * | 6/1996 | Elaini | F01D 5/225 416/190 |
| 6,491,498 | B1 * | 12/2002 | Seleski | F01D 5/147 415/173.4 |
| 2006/0263213 | A1 * | 11/2006 | Barb | F01D 5/147 415/208.1 |
| 2010/0068061 | A1 | 3/2010 | Iwai | |
| 2011/0110784 | A1 * | 5/2011 | DeMania | F01D 5/225 416/219 R |
| 2012/0195766 | A1 * | 8/2012 | Cohin | F01D 5/225 416/241 A |

FOREIGN PATENT DOCUMENTS

| | | | |
|---|---|---|---|
| EP | 1873355 | A1 | 1/2008 |
| JP | S54-178803 | U | 12/1979 |
| JP | 61205304 | | 9/1986 |
| JP | 2006322460 | | 11/2006 |
| JP | 2006336656 | | 12/2006 |

* cited by examiner

SHROUD FOR PRE-TWISTED AIRFOILS

FIELD OF THE INVENTION

The present invention relates to improvements to a shrouded blade in a turbomachine. It is particularly, but not exclusively, relevant to the moving blades as mounted onto the rotor of a steam turbine.

BACKGROUND OF THE INVENTION

In the following description the term "turbine" is used to refer to rotary engines having a stator and a rotating part force coupled by a fluid medium such as steam or gas. Of particular interest for the present invention are axial turbines comprising radially arranged fixed stator blades or vanes alternating with radially arrangements of moving rotor blades. Movements are generally registered as movements relative to a casing or housing.

The moving blades are designed to have a root at the bottom end to assemble with rotor and a shroud at the top end to engage with the shrouds of adjacent blades forming a ring. The moving blades are assembled on to the rotor having grooves in axial or circumferential direction. The axial grooves can be straight or curved.

It is known to assemble a row of blades such that each blade is twisted. The process of twisting can be regarded as forcing the blade from its unconstrained equilibrium state into a twisted state by applying mechanical constraints, typically by the forces applied at the root section and the top or shroud section.

A particular problem sought to be avoided is the excitation of natural or eigen frequencies of the blade (s) in turbine designs. Any type of resonant behavior of the blade or blade assembly has potentially a harmful impact upon the operation of a turbine and is hence to be avoided. A way of avoiding the resonances during operation is seen by using stiffer blade profiles and/or increased twist angles. Both solutions have disadvantages leading to increased stresses or difficulties in assembling a row of blades with a high degree of pre-stress. Blades assembled with higher pre-twist can be prone to bending instead of twisting as desired. It is therefore seen as an object of the invention to improve existing blade designs to increase the frequencies of the blade while at least partially avoiding the problems associated with previous solutions.

SUMMARY OF THE INVENTION

According to an aspect of the present invention, there is provided an indentation along the contact face of a shrouded blade, preferably of a pre-twisted blade for a turbine or, more generally a turbomachine, to increase the frequency of blade(s).

The indentation or depression is preferably located such that it overlaps partially with what would be the contact area between adjacent conventional shrouds with plane surfaces and hence without the indentation. In that manner the original contact area is effectively split and the new contact area includes parts of the face of the shroud beyond the width of the indentation. It can be seen as an aim of the invention to replace a single contact area with two contact areas separated by the indentation applied to the contact area or face of the shroud.

As the original contact area between adjacent conventional shrouds with plane surfaces is typically close to one (axial) end of the faces, the indentation could be in the middle of the face such that contact between adjacent segments making up the shroud is spread towards both ends of the shroud in axial direction.

This feature increases the frequencies at higher nodal diameter and hence increases the frequency stability of the row of shrouded blades.

In a preferred embodiment, the shroud segment has only an indentation at one of its circumferential ends, preferably with the depth of the indentation in the range up to 10 percent of the circumferential width of the shroud segment. For commercially used blades the depth is typically in the range of 0.1 mm to 5 mm or even in the range of 0.1 mm to 1 mm. If an indentation is split between the contacting faces of adjacent shrouds, the depths of each indentation can for example be halved or split according to any other desired ratio.

In another preferred embodiment, the indentation extends in radial direction along a line covering at least the full radial length of the potential contact area between two adjacent shroud segments. Depending on its shape, part of the indentation can extend in axial direction to the edges of the potential contact area and thus even to the edges of the shroud segment.

In another preferred embodiment, the indentation extends in axial direction along at least 0.1 times or at least 0.3 times the total axial width of the shroud segment and is even more preferably centered around the circumferentially oriented centroid of the shroud segment.

The indentation can also be applied to define the radial position of the contact areas. For example, the indentation can be generally T-shaped with a broader strip of material removed above the axial center line of the face to ensure contact between adjacent shrouds below this center line. If the indentation includes broader strips removed both, above and below this center line, the contact areas can be confined to locations on or close to it.

In case the engaging faces of the shroud segments have steps in circumferential direction or similar geometrical alterations, the above indentation can be applied to each face facing in circumferential direction, i.e., to each face at which the shrouds contact each other.

These and further aspects of the invention will be apparent from the following detailed description and drawings as listed below.

BRIEF DESCRIPTION OF THE DRAWINGS

Exemplary embodiments of the invention will now be described, with reference to the accompanying drawings, in which.

DETAILED DESCRIPTION OF THE INVENTION

Aspects and details of examples of the present invention are described in further details in the following description using the example of a row of blades or airfoils mounted onto the rotor of a steam turbine.

Figure 1:
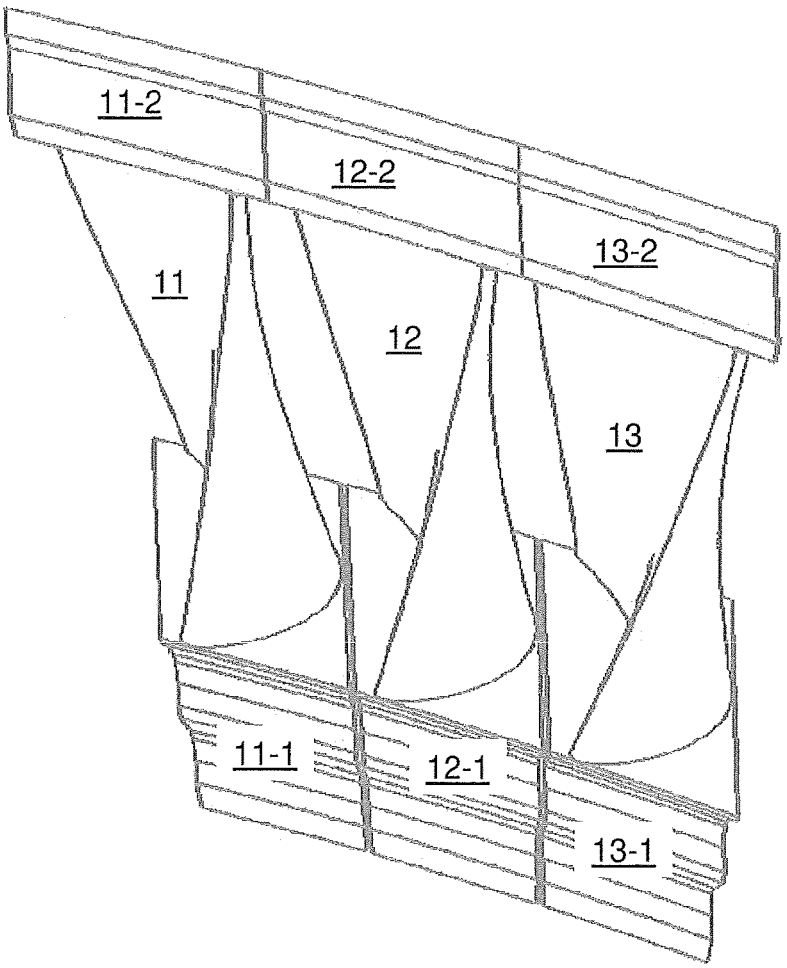
FIG. 1(Prior Art)
FIG. 1 shows a group of three blades or airfoils engaging each other with their shroud segments.

A group of three blades 11, 12, 13 is shown in the perspective view of FIG. 1. Each blade has a root section 11-1, 12-1, 13-1 for insertion into corresponding circumferential grooves of a rotor (not shown). At the top of each blade the actual airfoil is topped with a shroud segment 11-2, 12-2, 13-2. The shroud segments make up a complete circumferential ring referred to as the shroud. In the example, the shroud segments are contacting each other but are in principle free to move relatively to each other. Consequently, the shroud segments are moving from their assembled positions into an operational position caused by the rapid rotation of the rotor at for example 25, 30, 50 or 60 Hz.

A pre-twisting of the blades can be achieved by enlarging the circumferential lengths of the shroud segments 11-2, 12-2, 13-2 by a small amount beyond the nominal length as determined by dividing the circumference of the shroud by the number of blades per row. When the blades are assembled into the grooves of the rotor, a twist is generated as the shroud segments rotate to accommodate the extra length. Alternatively, a coupling of blades at the shroud can also be achieved through an untwisting of an aerofoil due to rotation. In this variant pre-twisting is not required the shroud segments have at assembly a small clearance which closes at the operating speed of the turbine.

When the contacting faces of two adjacent shroud segments, such as 11-2, 12-2, are planar, the twist generates a contact area. Typically this contact area is close to one of the axial ends of the contacting faces.

Figure 2A:
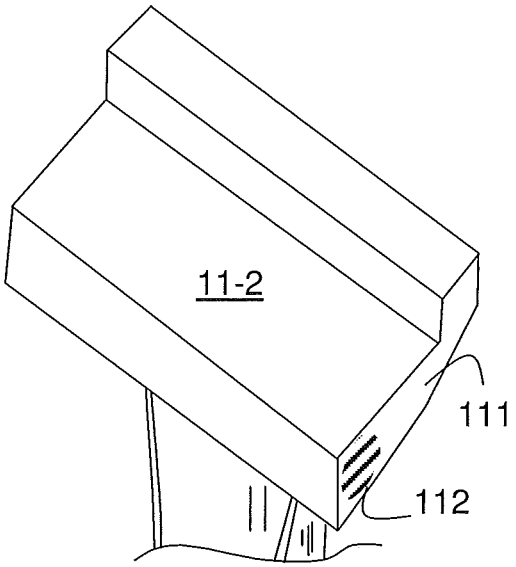
FIG. 2A shows a more detailed schematic three-dimensional view of the top of a single blade and shroud segment as known.
Figure 2B:
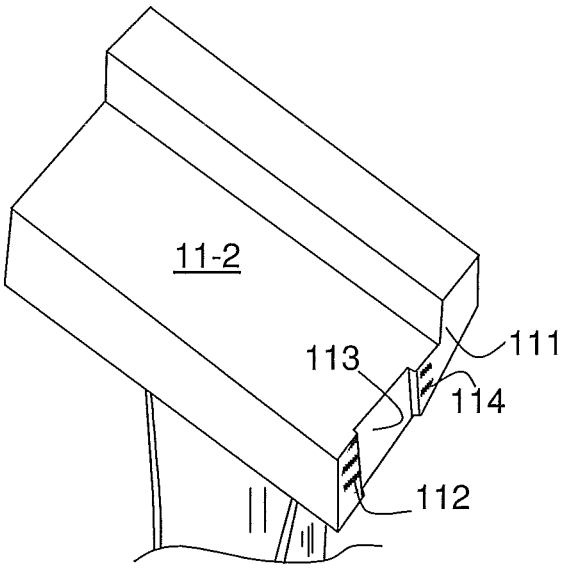
FIG. 2B is the same view as in FIG. 2A of the top of a single blade and shroud segment in accordance with an example of the present invention.

The effect of the present invention is illustrated by a comparison between the shroud segment 11-2 of a known blade as shown in FIG. 2A and a shroud segment 11-2 of a blade in accordance with an example of the invention as shown in FIG. 2B. In FIG. 2A, the face 111 of the shroud segment 11-2 which is designed to be in contact with an adjacent shroud segment. Is shown as a flat surface. As stated above, in an assembled row the contact area 112 will be close to one of the axial ends of the contacting faces. In the perspective view of FIG. 2A, the contact area 112 is shown as a hatched patch at the proximate axial end of the face 111.

In the example of FIG. 2B, a shallow indentation or depression 113 has be machined into the face 111. The location of the indentation 113 overlaps partially with the original contact area 112. The indentation prevents a contact at the overlapping part of the original contact area 112 and causes a second contact area 114 at the face 111 at the opposite side of the indentation 113. The contact area is effectively split into the remaining part of the original contact area 112 and the new contact area 114. Having two contact areas is thought to make the shrouded blades stiffer.

Figure 2C:
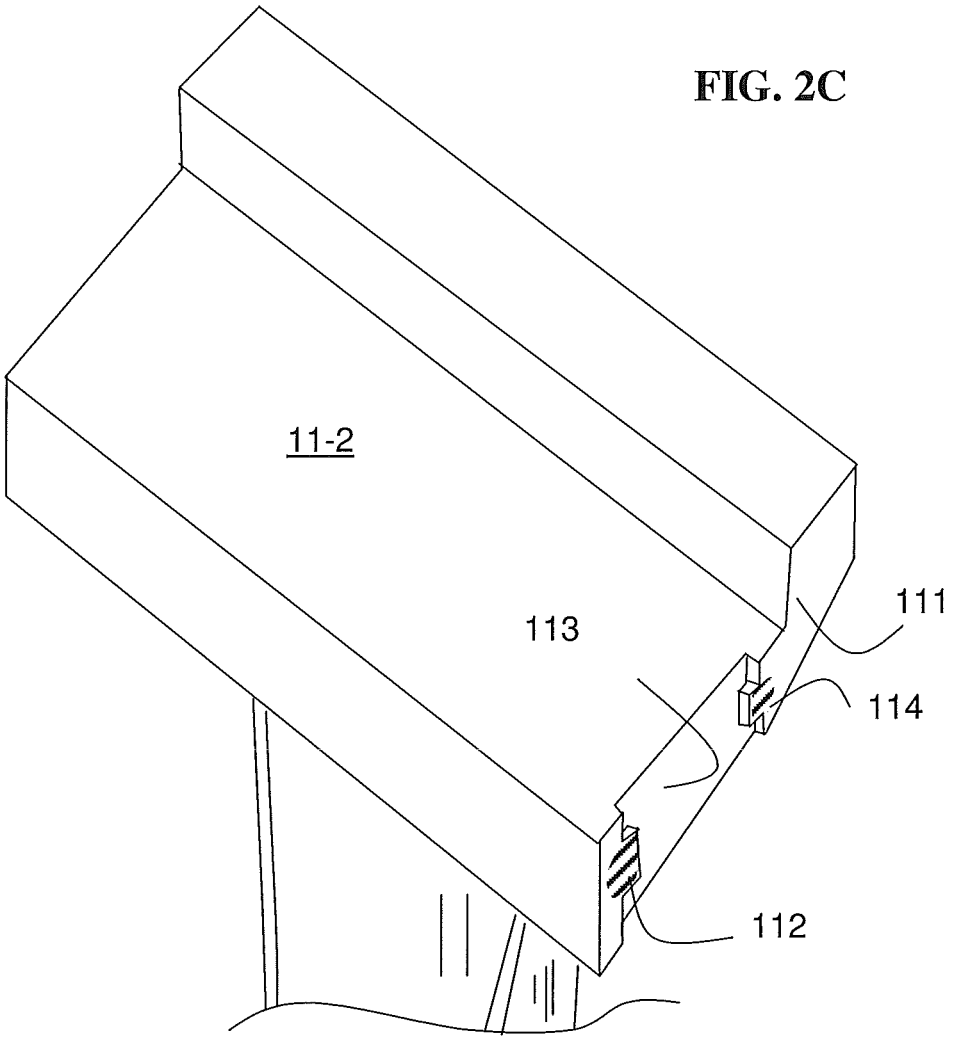
FIG. 2C shows a shroud segment modified in accordance with another example of the present invention.

The indentation of FIG. 2B is a simple shallow groove of rectangular shape. However it may be advantageous to cut the groove into more complex shapes to force the remaining contact areas 112, 114 to positions where the stability or stiffness of the shroud is increased. For example, in FIG. 2C the cross-section of the groove 113 is formed as a capital H or double T. This shape forces a contact at two areas 112, 114 close to the (radial) center line of the shroud segment 11-2. In other variants (not shown) a simple T shape can be used to move the contact areas for example towards the bottom part of the shroud segment below to the (radial) center line or to the top above the radial center line. In a variant of this example, part of the indentation can extend in axial direction to the edges of the face 111.

Figure 3A:
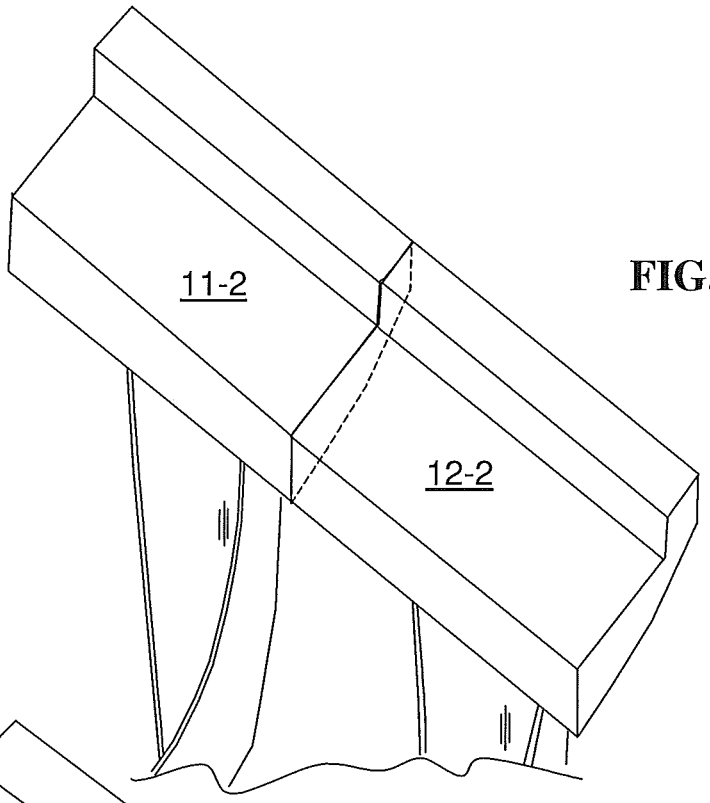
FIG. 3A is a schematic three-dimensional view of two engaging shroud segments as known.

In FIG. 3A two adjacent shroud segments 11-2, 12-2 are shown with flat contacting surfaces as known. Hidden lines are shown as dashed lines.

Figure 3B:
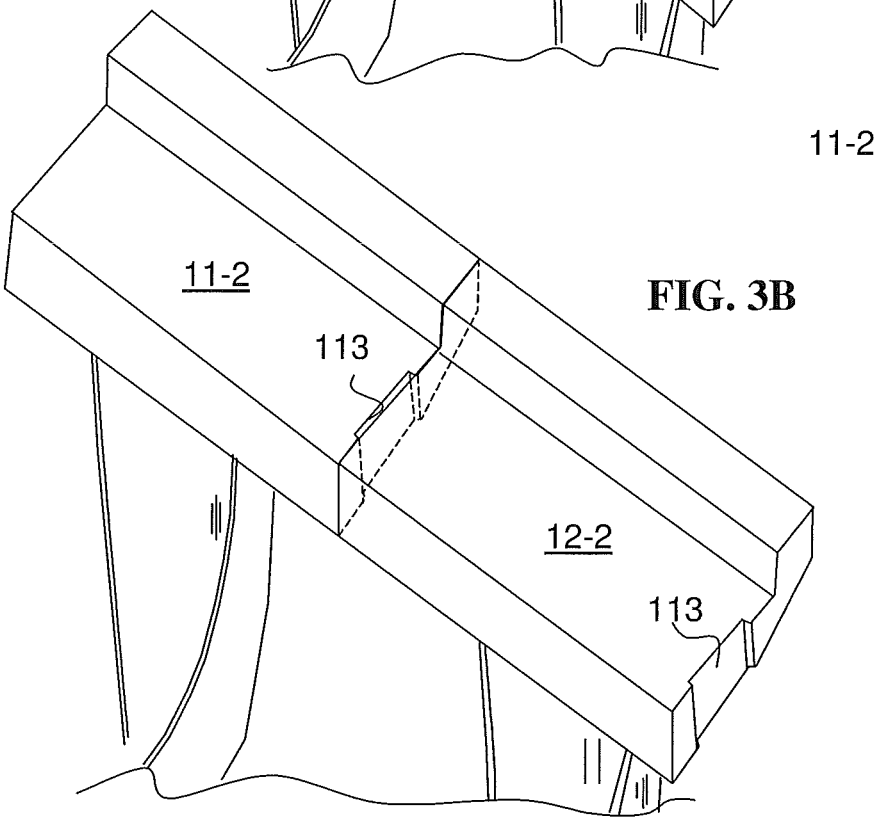
FIG. 3B is the same view as in FIG. 3A of two engaging shroud segments in accordance with an example of the present invention.

In FIG. 3B two adjacent shroud segments 11-2, 12-2 are shown with the contacting faces altered in accordance with an example of the invention. As described above the indentation 113 causes the opposing faces of the shroud segments 11-2, 12-2 to contact each other at two separate locations at the either side of it.

In the examples of FIGS. 2B and 3B, the shallow indentation is applied to only one of the engaging faces of a shroud segment. It is however equally possible to have indentations on both of the engaging faces of a shroud segment, in which case each indentation can be made shallower as each indentation contributes to the separation of the adjacent shrouds.

The total depth of an indentation is typically designed be just sufficient to achieve the desired separation of the contact area, without influencing the overall mechanical stability and leakage behavior of the shroud. It is found that a depth of less than 10 percent of the circumferential width of the segment translating for typical shroud segment to between 0.1 mm and 5 mm can be sufficient for most applications and blade designs.

The (axial) width of the indentation is also subject to similar design constraints and can be in the range of 10 percent to 90 percent of the total axial width of the shroud segment. Typically a width of around 50 percent of the total width of the shroud is found sufficient to achieve an effective separation of the contact area.

The height of indentation (in radial direction) is typically the same as the height of the engaging surface, i.e., cutting across it. However, if the original contact areas are precisely known, a smaller indentation can be applied to just the contact area to achieve an effective separation.

It should further be noted that the above example can equally be applied to more complex geometries of the engaging surfaces of the shroud segments using the same principle as applied above. In case that the engaging surfaces of the shroud segments have a step in circumferential direction thus forming two circumferentially facing potential contact areas, an indentation as described above can be applied to a contacting area on either of them or both as required to separate the contact area or areas.

To enhance the mechanical stability of the indentation, it is preferred to machine or cut the indentation such that its side walls are chamfered thus avoiding edges which deform under load.

Figure 4:
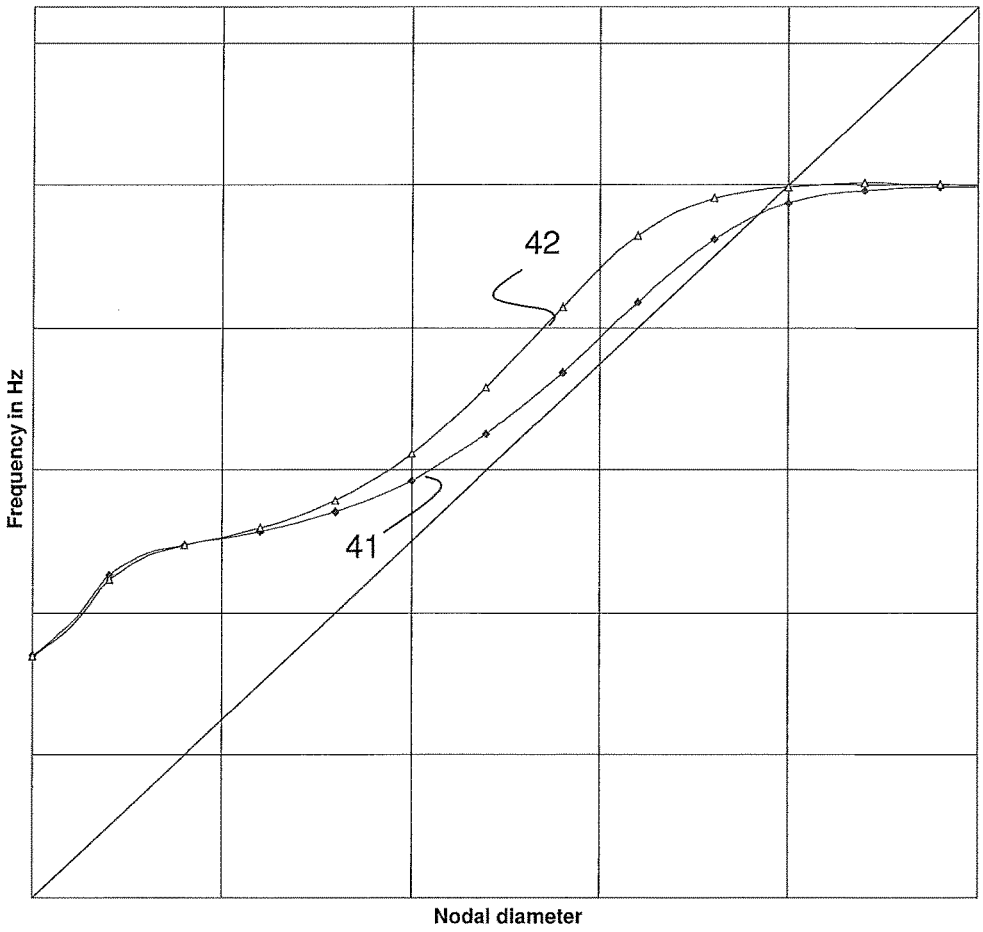
FIG. 4 illustrated a shift in frequency for the first mode of a row of airfoils in accordance with an example of the invention compared to the same row but without modifications.

The potential effect of the modifications to the shroud segments is illustrated in the graph of FIG. 4. The graph shows the frequencies of axial bending modes for the first twenty-five nodal diameters. The lower curve 41 gives the frequencies of a conventional shroud, whereas the upper curve 42 reflects the behavior of a shroud assembled from shroud segments with the indentation or relief groove. In the critical band between the two plateaus the frequency shift between the two curves exceeds 10 percent for many nodal diameters making it less likely that these frequencies will be excited during normal operation or allowing an operator or designed to operate the steam turbine in a broader envelope of parameters.

The present invention has been described above purely by way of example, and modifications can be made within the scope of the invention. The invention may also comprise any individual features described or implicit herein or shown or implicit in the drawings or any combination of any such features or any generalization of any such features or combination, which extends to equivalents thereof. Thus, the breadth and scope of the present invention should not be limited by any of the above-described exemplary embodiments.

Each feature disclosed in the specification, including the drawings, may be replaced by alternative features serving the same, equivalent or similar purposes, unless expressly stated otherwise.

Unless explicitly stated herein, any discussion of the prior art throughout the specification is not an admission that such prior art is widely known or forms part of the common general knowledge in the field.

The invention claimed is:

1. A blade for a turbine, comprising:

a shroud segment at a top end of the blade, the shroud segment configured to engage with shroud segments of corresponding adjacent blades in a ring-shaped assembly, the shroud segment having a first engaging face having an indentation, wherein the indentation comprises at least one chamfered side wall, and a second engaging face located at an opposing side of the shroud segment from the first engaging face, the first engaging face being a planar surface and configured to engage with a second engaging face of the shroud segment of the corresponding adjacent blade, and wherein the indentation has a H-shaped cross-section.

2. The blade of claim 1, wherein the blade is a pre-twisted blade.

3. The blade of claim 1, wherein the indentation along the first engaging face includes two contact areas which engage with the second engaging face of the shroud segment of the corresponding adjacent blade, wherein each contact area of the first engaging face is located adjacent to the indentation along an axial direction.

4. The blade of claim 1, wherein the indentation has a depth in the range at least 0.1 mm to up to 10 percent of the circumferential width of the shroud segment.

5. The blade of claim 1, wherein the indentation has a width in an axial direction of 10 percent to 90 percent of the total axial width of the shroud segment.

6. The blade of claim 1, wherein the indentation has a shape adapted to determine radial positions of the contact areas.

7. The blade of claim 1, having a root section for insertion into a rotor of a turbomachine.

8. The blade of claim 1, having a root section for insertion into a rotor of a steam turbine.

9. A method of increasing a frequency of a ring assembled from blades for a turbine including a shroud segment at a top end of each blade, each shroud segment configured to engage with the shroud segments of corresponding adjacent blades in the ring, each shroud segment having a first engaging face having an indentation, and a second engaging face located at an opposing side of the shroud segment from the first engaging face being a planar surface and wherein the indentation has an H-shaped cross-section, the method comprising:

machining the indentation into the first engaging face of each shroud segment, wherein machining the indentation comprises machining the indentation to comprise at least one chamfered side wall; and assembling the blades including the shroud segments into the ring so that the first engaging face of each shroud segment engages with a second engaging face of the shroud segment of the corresponding adjacent blade.

10. The blade of claim 1, wherein the indentation has a rectangular shaped cross-section.

11. The method of claim 9, wherein machining the indentation further comprises machining the indentation into middle of the first engaging face of each shroud segment.

* * * * *